United States Patent [19]

Sako et al.

[11] Patent Number: 4,969,844

[45] Date of Patent: Nov. 13, 1990

[54] ELECTROMAGNETIC CONTECTOR

[75] Inventors: Yuji Sako; Shigeharu Ootsuka, both of Aichi, Japan

[73] Assignee: Mitsubishi Denki Kabushiki Kaisha, Tokyo, Japan

[21] Appl. No.: 414,333

[22] Filed: Sep. 29, 1989

[30] Foreign Application Priority Data

| | | | |
|---|---|---|---|
| Oct. 6, 1988 | [JP] | Japan | 63-252583 |
| Oct. 7, 1988 | [JP] | Japan | 63-253076 |
| Oct. 11, 1988 | [JP] | Japan | 63-255108 |
| Jan. 25, 1989 | [JP] | Japan | 64-15808 |

[51] Int. Cl.[5] ..... H01R 13/40

[52] U.S. Cl. ..... 439/733; 335/202; 336/192

[58] Field of Search ..... 335/156, 157, 202; 361/353, 363, 372, 373, 376, 426; 439/709, 712, 720, 721, 722, 723, 724, 733, 444, 869; 336/192

[56] References Cited

U.S. PATENT DOCUMENTS

| | | | |
|---|---|---|---|
| 4,834,680 | 5/1989 | Schmiedel et al. | 439/733 |
| 4,837,538 | 6/1989 | Dittmann | 335/202 |

FOREIGN PATENT DOCUMENTS

| | | | |
|---|---|---|---|
| 2854591 | 6/1979 | Fed. Rep. of Germany | 335/202 |
| 2252642 | 6/1975 | France | 335/202 |
| 2061621 | 5/1981 | United Kingdom | 335/202 |

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

An electromagnetic contactor comprises a resin-molded housing for accommodating a fixed contact member in its inner space; resin-molded terminal covers, each being capable of insertion from the outside for assembly along a guide portion of a recess or boss formed in the housing and of passing through the housing up to its inner space, each terminal cover having a slit opened to the outside; and fixed-contact-member connection conductors, each formed of a bent metal plate having a contact of the fixed contact member at one end and the plug-in connection type male terminal at the other end, the plug-in connection type male terminal being projected from the slit, the fixed-contact-member connection conductor being further provided with a mating portion which mates with the terminal cover in such a manner that the conductor in combination with the terminal cover can be assembled in the housing.

15 Claims, 10 Drawing Sheets

ELECTROMAGNETIC CONTECTOR

BACKGROUND OF THE INVENTION

The present invention relates to an electromagnetic contactor having plug-in connection type terminals.

FIGS. 9–11 show a conventional electromagnetic contactor: FIG. 9 is an elevation sectional view thereof; FIG. 10 is a top view; and FIG. 11 is a view showing construction of a fixed contact member. There is shown therein an arrangement of a molded housing 1, a base 2 and a pair of fixed contact members 3 disposed on each pole, the fixed contact member 3 being fitted to the housing 1 as shown in FIG. 11. More specifically, the fixed contact member 3 is fitted into a fixed-contact-member fitting portion 1*a* of the housing 1, the dimension Y of the U-shaped inner part of the fixed contact member 3 being smaller than the width X of the fixed-contact-member fitting portion 1*a*. A spring force caused by extension of the U-shaped dimension Y of the fixed contact member 3 up to the dimension X of the fitting portion 1*a* of the housing 1 allows the fixed contact member 3 to be fixedly fastened to the housing 1. A fixed contact 3*a* is fitted to one end of the fixed contact member 3 and the fixed contacts 3*a* are disposed opposite to respective moving contacts 4*a* provided on both sides of a moving contact member 4. A screw hole 3*b* is formed in the fixed contact member 3 and a plug-in connection type male terminal 5 is fixed to the fixed contact member by means of a clamp screw 6 screwed into the hole.

A tip 5*a* of the plug-in connection type male terminal 5 is formed so that a plug-in connection type female terminal (connector) (not shown) is mated with the terminal 5. A cross bar 16 is coupled to a moving iron core 7 at its lower end, and vertically and slidably holds the moving contact members 4 provided for each pole in its upper portion. A contact spring 8 is used to impart contact pressure to the moving contact member 4.

The cross bar 16 is slidably held by the housing 1 in such a manner that it is made vertically movable in FIG. 9. A fixed iron core 9 and operating coils 10 both are fixed to the housing 1 and the base 2. Kick out springs 11 are disposed so as to urge the cross bar 16 upward. Fixed screws 12 are employed to secure the housing 1 to the base 2. An operating coil 10 is wound on a coil frame 30 and a coil terminal 31 is inserted into the coil frame 30. The terminal of the operating coil 10 is connected to one end of the coil terminal 31, whereas a substantially L-shaped plug-in connection type male terminal 32 is connected to the other end of the coil terminal by means of a clamp screw 33 which is screwed into a threaded hole provided in the other end. A tip 32*a* of the plug-in connection type male terminal 32 is formed so that it is fitted into the plug-in connection type female terminal (not shown).

In operation, the attraction of magnetic flux generated when voltage is applied to the operating coils 10 has the moving iron core 7 attracted to the fixed iron core 9, whereby the cross bar 16 coupled to the moving iron core 7 moves against the force of the kick out springs 11 in the downward direction in FIG. 9. The moving contact member 4 held by the cross bar 16 also moves down so that their moving contacts 4*a* come in contact with the respective opposite fixed contacts 3*a*. As each part is so dimensioned as to move the cross bar slightly below the contact position, the cross bar 16 becomes slightly lower than the positions of the contacts (an over travel amount). Consequently, the contact spring 8 is compressed and the compression force is applied to the moving contact member 4 in the form of a contact pressure. As a result, the fixed contact members 3 at the left- and right-hand sides shown in FIG. 9 are electrically connected.

When the voltage applied to the operating coils 10 is switched off, the electromagnetic force between the moving iron core 7 and the fixed iron core 9 is extinguished and the cross bar 16 is caused by the force of the kick out springs 11 to move in the upward direction in FIG. 9. As a result, the contact between the moving contacts 4*a* and the fixed contacts 3*a* are broken to provide an open channel. The circuit of the electromagnetic contactor is thus opened and closed.

A description will subsequently be given to the connection and disconnection of the connectors to the plug-in connection type male terminals 5 and 32. In FIG. 9, the plug-in connection type female terminals (not shown) are inserted in direction of arrow A for connection, whereas they are pulled out in direction of arrow B for disconnection. When the plug-in connection type female terminals (not shown) are removed, however, they often remain rather firmly mated with the plug-in connection type male terminals 5 and 32. Thus, the plug-in connection type female terminals (not shown) are pulled out while they are twisted in direction of arrow C.

Since the conventional electromagnetic contactor is thus constructed, force is applied to even the fixed contact member 3 in both directions of B and C shown in FIG. 9 when the female terminal is removed from the plug-in connection type male terminal 5. This means the dimension Y of the U-shaped inner part of the fixed contact member 3 shown in FIG. 11 is increased. When the elastic stress applied to the fixed contact member exceeds limitation, the dimension Y is subjected to permanent deformation and comes up close to or exceeds the dimension X of the housing 1.

Variations of the dimension Y result in making the fixed contact member 3 loosely fixed to the housing 1 and, in the worst case, causing it to be unsteadily fixed thereto or making the over travel amount changed due to a change of position of the fixed contact 3*a*, or further inducing the falling off of the fixed contact member itself. For this reason, measures have to be taken to increase the force of fixing the fixed contact member 3 to the housing 1 by, for example, increasing the thickness of the plate thereof. Despite such measures are taken, there still remain some apprehensions for great force unexpectedly exerted at the time the fixed contact member 3 is removed.

When the female terminal is removed from the plug-in connection type male terminal 32, moreover, the force (in directions of arrows B, C) is applied so that the coil terminal 31 or the plug-in connection type male terminal 32 is subjected to deformation, thus making the operation impossible as the discription occurs at the terminal of the operating coil 10 connected to the end of the coil terminal 31. In addition, there are problems that a number of parts are required and it takes long time in assembly work.

SUMMARY OF THE INVENTION

The present invention was made to solve the foregoing problems and it is therefore an object of the invention to provide an inexpensive electromagnetic contactor designed to increase the strength thereof when plug-in connection type female terminals are fitted to or removed off male terminals and to prevent fixed contact members and coil terminals from being unsteadily fixed or deformed during operation.

An electromagnetic contactor embodying the present invention comprises a terminal cover being fitted along a guide portion of a recess or boss formed in a housing, and fixed-contact-member connection conductor being combined with a plug-in connection type male terminal and being inserted into a slit of the terminal cover.

The terminal cover and the housing are responsible for bearing the load applied to the connection conductor and positioning the same.

The electromagnetic contactor according to the present invention further comprises a plug-in connection type male terminals of coil connection conductor, being passed through a slit provided at the outer end of the terminal cover and supported by and mated with a base.

The electromagnetic contactor according to the present invention still further comprises a fixed contact member, being formed with a metal plate having a contact at one end and a plug-in connection type male terminal at the other, the fixed contact member being inserted into the resin-molded terminal cover to protrude the external terminal from the slit provided in the terminal cover, which is inserted in the recess and groove of the housing and fixed thereto.

While the terminal cover is inserted in the recess and groove of the housing, a pin provided on the underside of the terminal cover is mated with the stopper recess of the housing in the position of insertion.

Also tongues provided on the fixed contact member are inserted in grooves provided in the wall between poles of the housing.

Moreover, the plug-in connection type male terminal provided at one end of the coil terminal is inserted into the coil terminal slit provided at the end of the terminal cover.

In the present invention, each of the plug in connection type male terminals is positioned and fixed by the slit provided in the terminal cover and the terminal cover is fixed by means of the recess and groove of the housing.

Moreover, the vertical movement of the fixed contact member is restrained by the tongues of the fixed contact member and the groove of the housing.

Further, the pin of the terminal cover prevents the terminal cover being slipped off.

BRIEF DESCRIPTION OF THE INVENTION

DETAILED DESCRIPTION OF THE INVENTION

Figure 1:
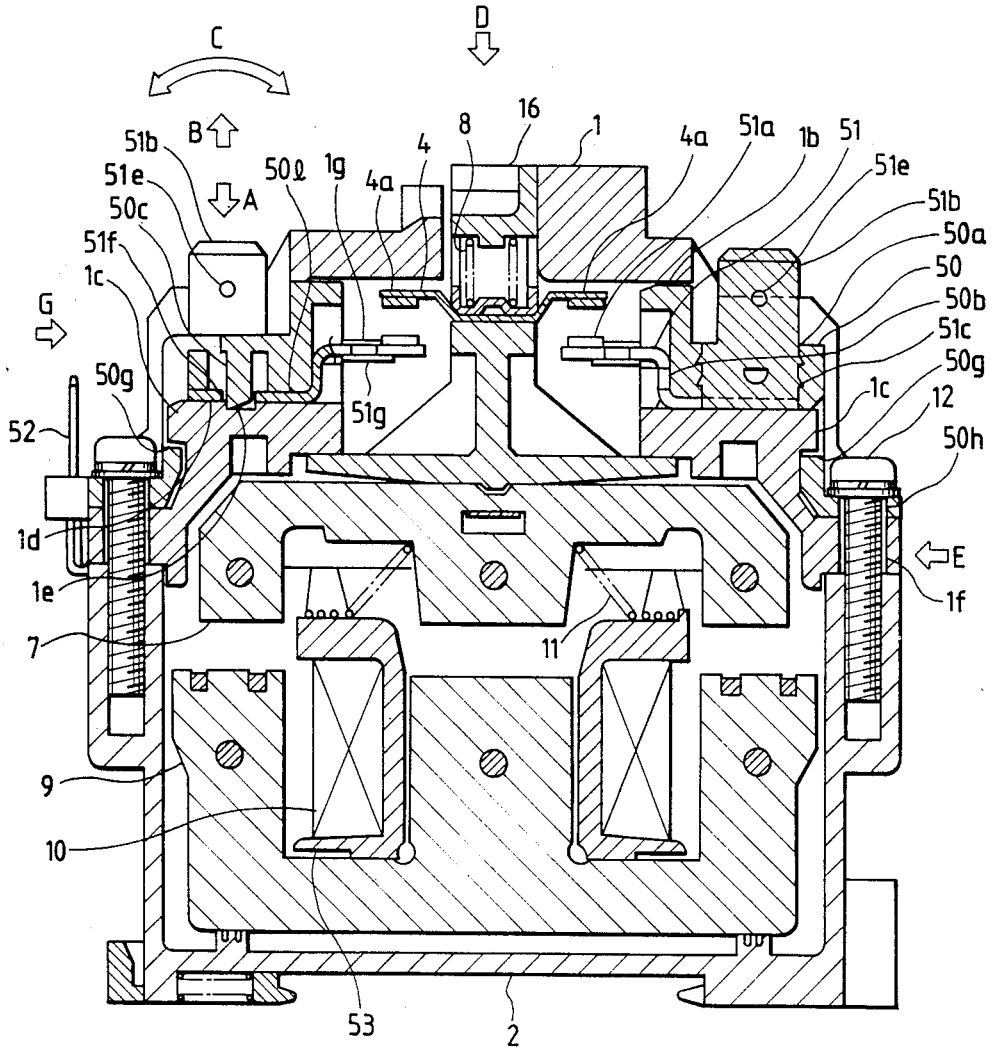
FIG. 1 is an elevational sectional view of an electromagnetic contactor according to an embodiment of the present invention.
Figure 2:
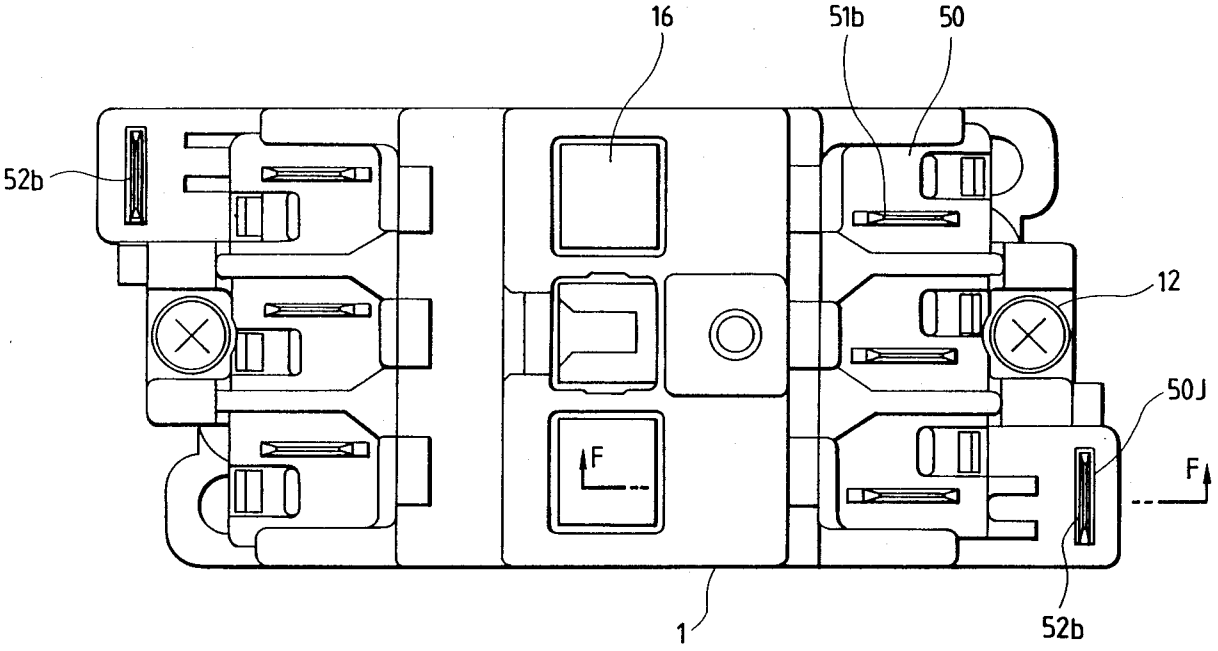
FIG. 2 is a top view as viewed from arrow D of FIG. 1.
Figure 3:
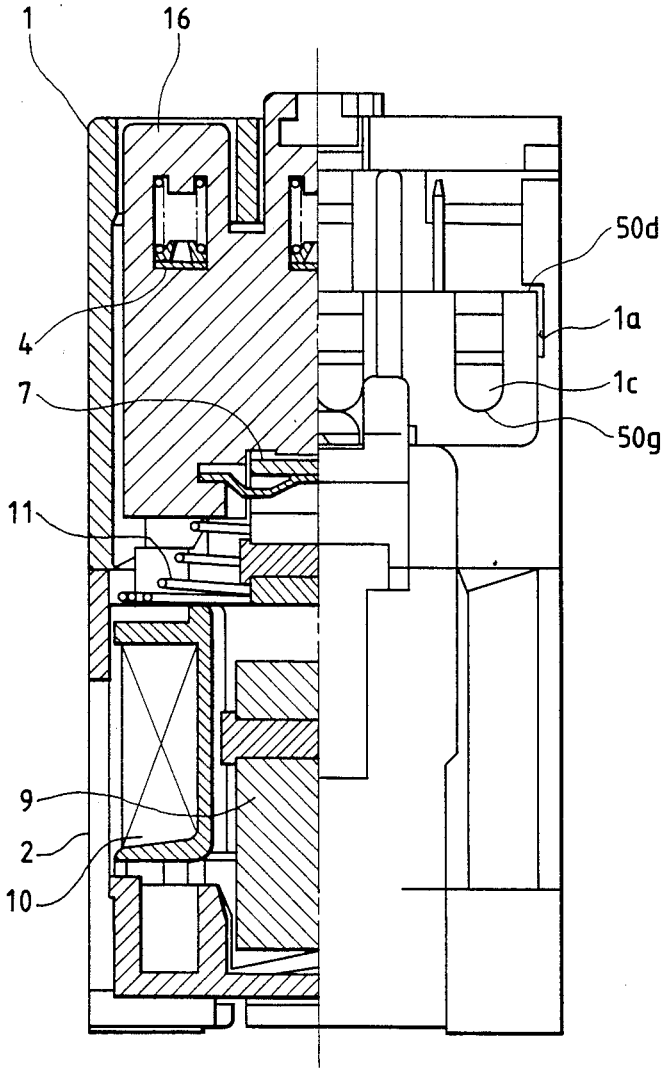
FIG. 3 is a half side sectional view as viewed from arrow E of FIG. 1.
Figure 4:
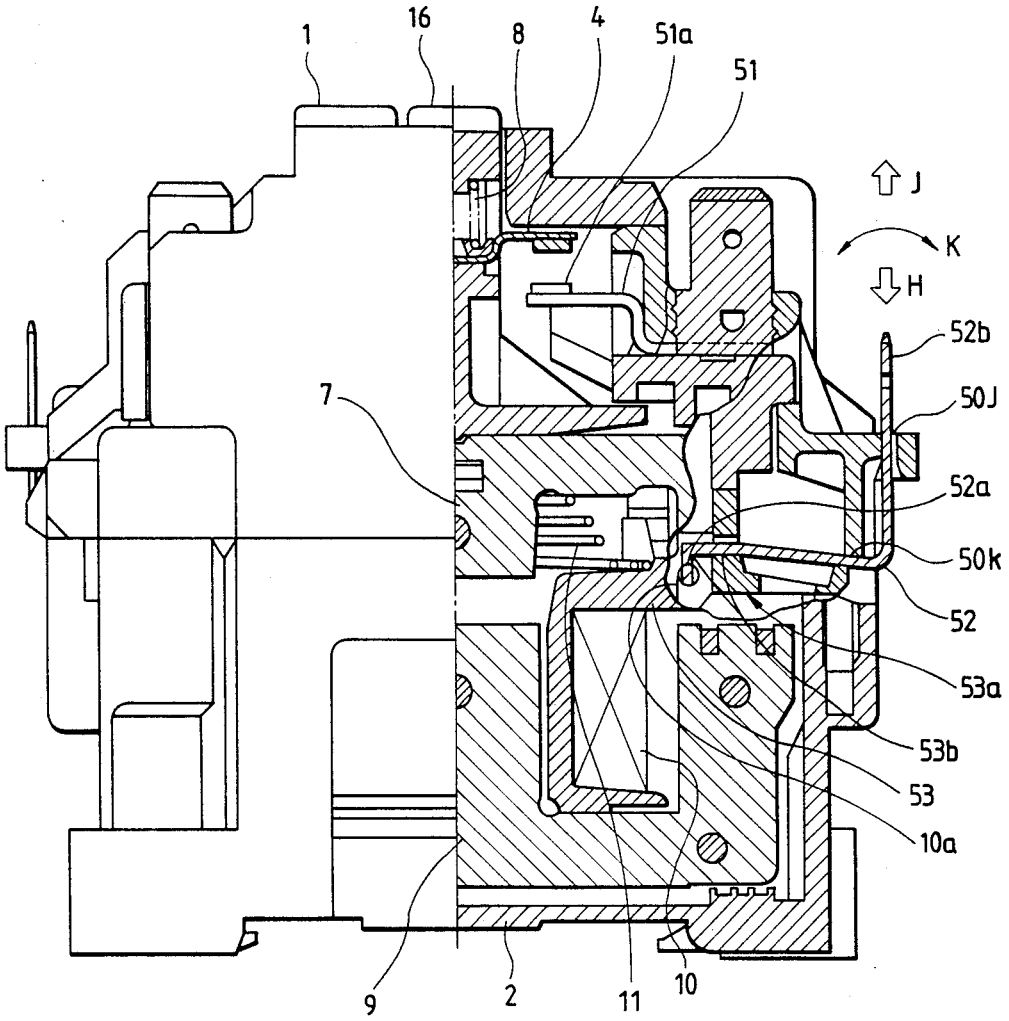
FIG. 4 is a sectional view taken along line F—F of FIG. 2.
Figure 5:
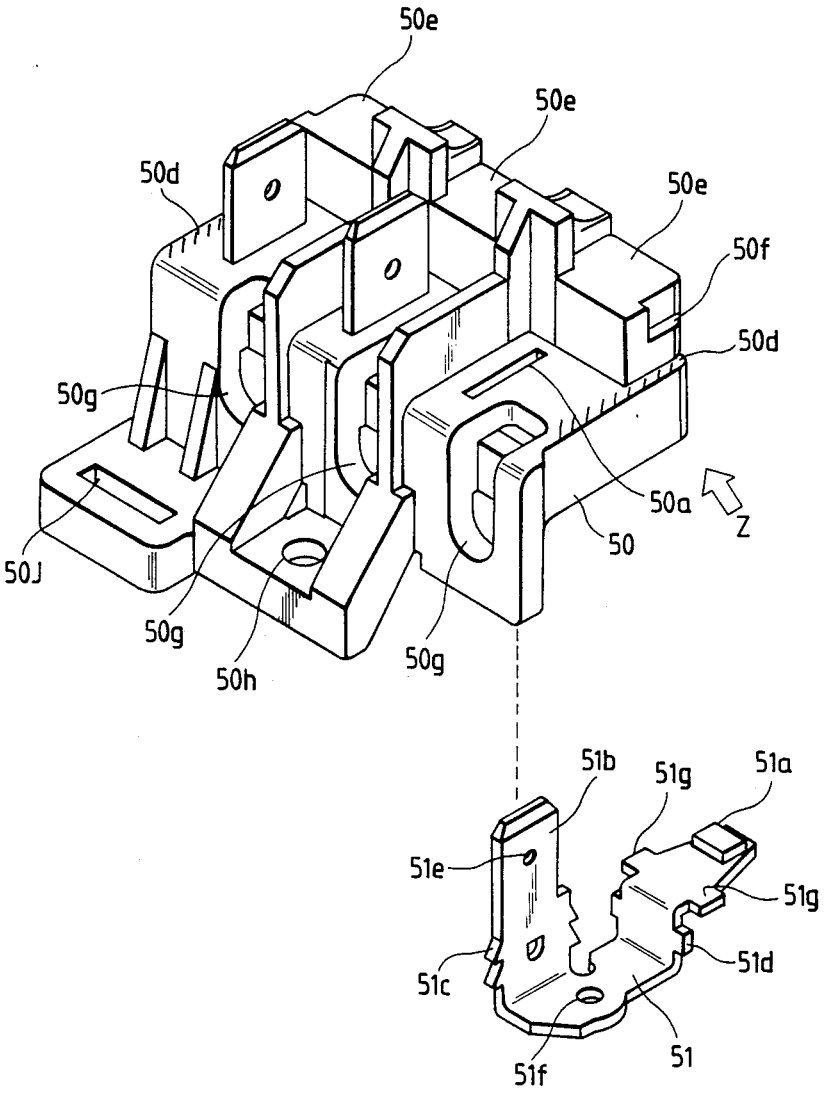
FIG. 5 is a perspective view illustrating a process of assembling a terminal cover and a fixed contact member.
Figure 6:
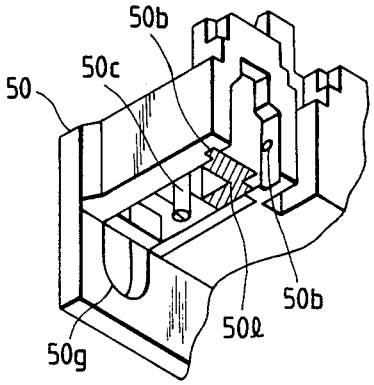
FIG. 6 is a perspective view as viewed from arrow Z of FIG. 5.

Referring to the accompanying drawings, an embodiment of the present invention will subsequently be described. FIG. 1 is an elevational sectional view of the embodiment. FIG. 2 is a top view as viewed from arrow D of FIG. 1. FIG. 3 is a half side sectional view as viewed from arrow E of FIG. 1. FIG. 4 is a sectional view taken along line F—F of FIG. 2. FIG. 5 is a perspective view illustrating a process of assembling a terminal cover and a fixed contact member. FIG. 6 is a perspective view as viewed from arrow Z of FIG. 5.

Figure 7:
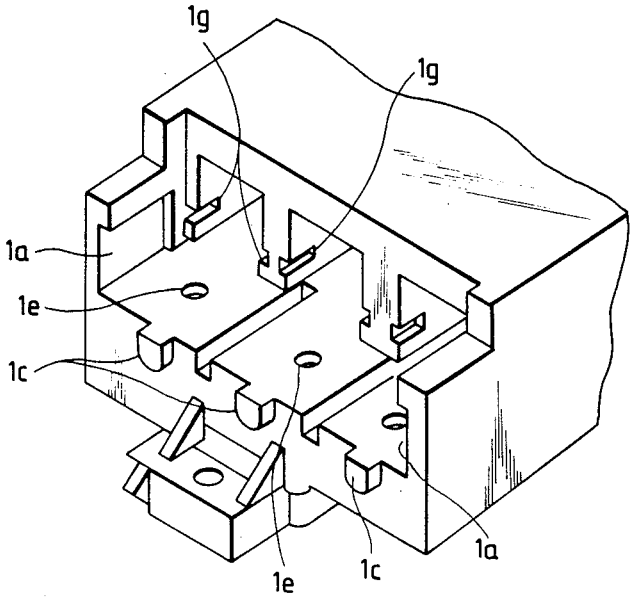
FIG. 7 is a partial perspective view of a housing of the electromagnetic contactor shown in FIG. 1.

FIG. 7 is a partial perspective view of a housing wherein the terminal cover is assembled.

Figure 8:
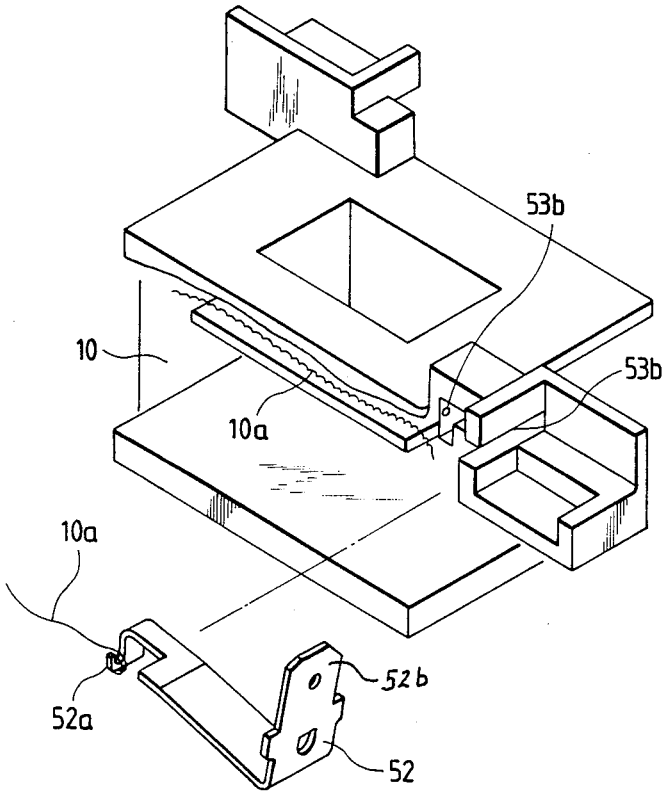
FIG. 8 is a perspective view illustrating parts of the electromagnetic contactor shown in FIG. 1.
Figure 9:
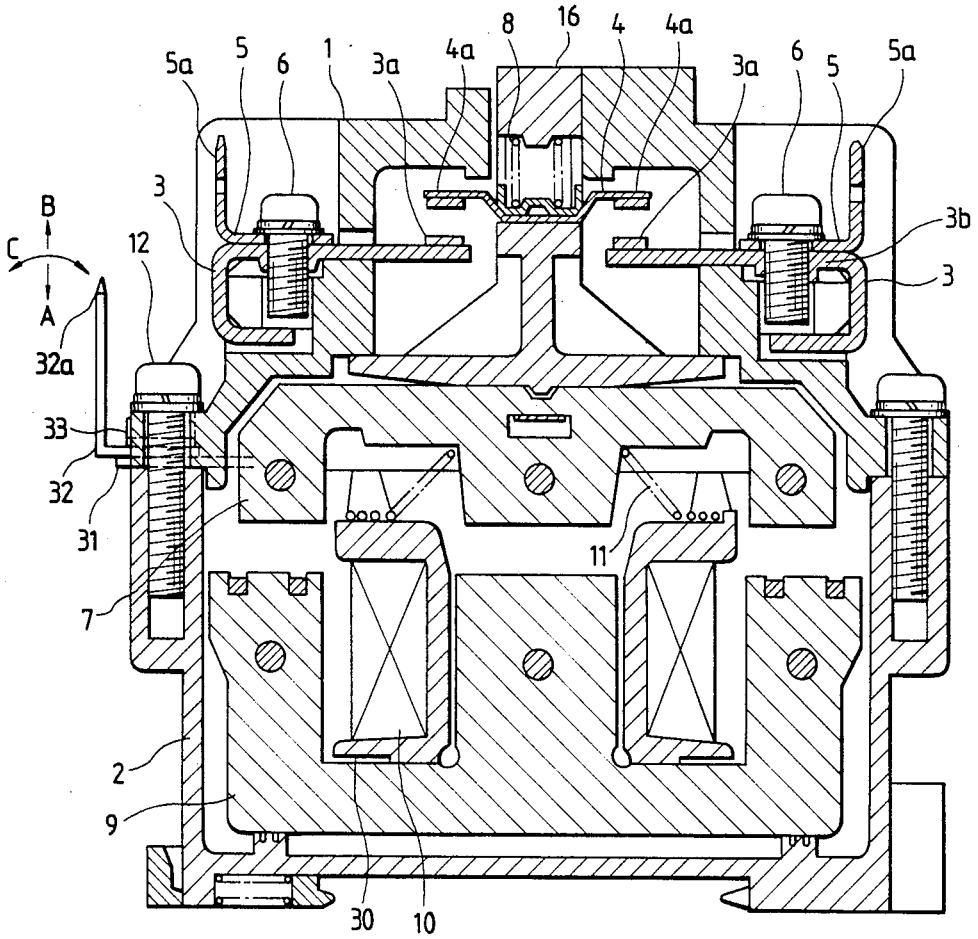
FIG. 9 (PRIOR ART)
FIG. 9 is an elevational sectional view of a conventional electromagnetic contactor.
Figure 10:
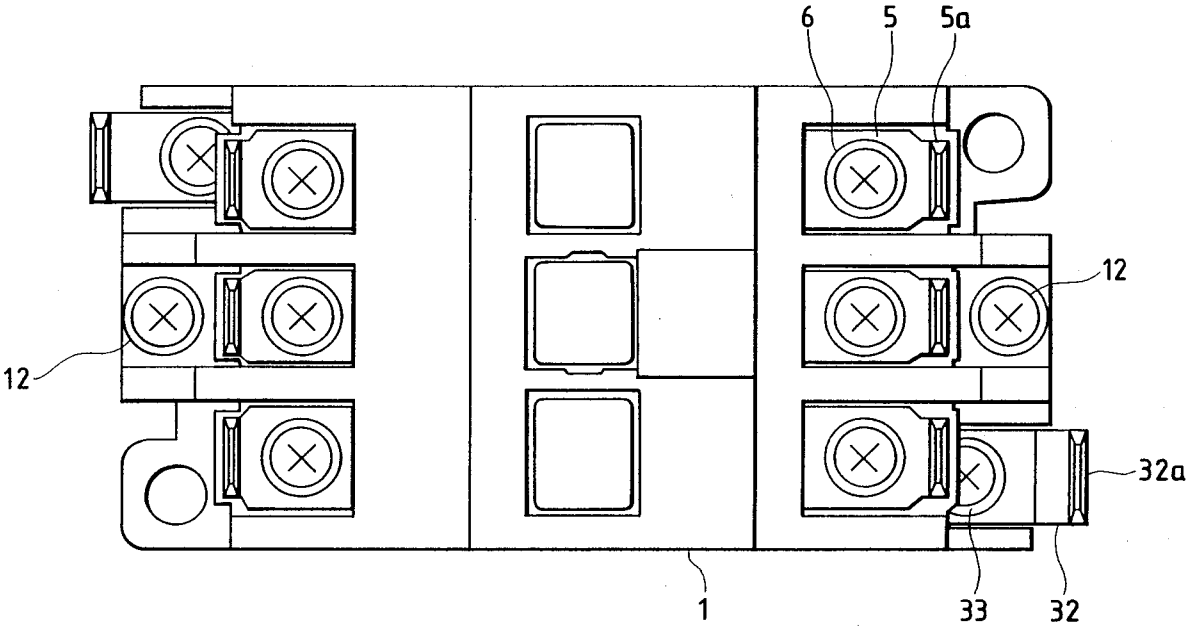
FIG. 10 (PRIOR ART)
FIG. 10 is a top view of the conventional electromagnetic contactor shown in FIG. 9.
Figure 11:
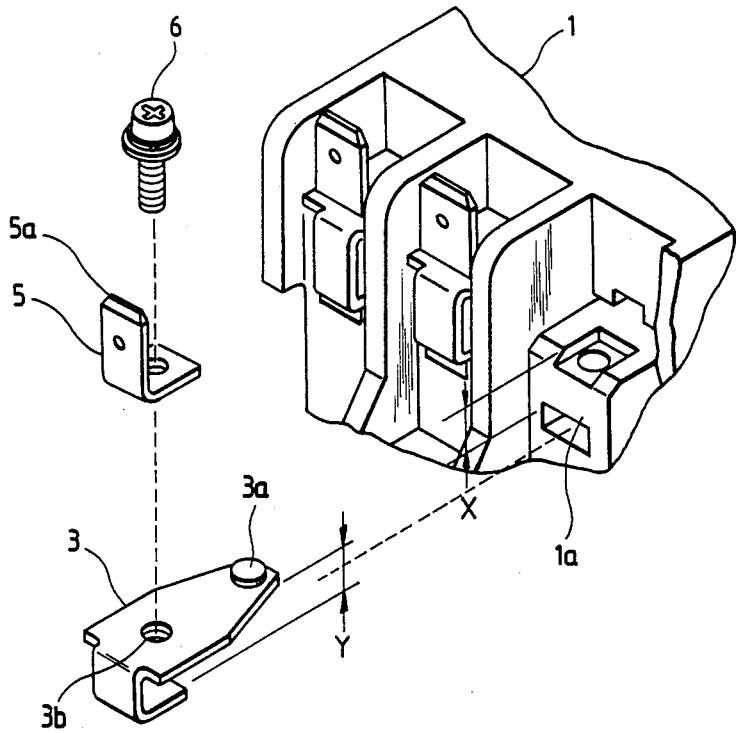
FIG. 11 (PRIOR ART)
FIG. 11 is a perspective view showing the assembly of a fixed contact member and a housing of the conventional electromagnetic contactor shown in FIG. 9.

FIG. 8 is a perspective view illustrating parts for assembly in a coil connection conductor.

In FIGS. 1–8, like reference characters designate like parts given in the conventional electromagnetic contactor; that is, the parts include a housing 1, a base 2, a moving contact member 4, a cross bar 16, a moving iron core 7, a contact spring 8, a fixed iron core 9, operating coils 10, kick out springs 11, fixed screws 12. On the other hand, each of terminal covers 50 fixedly accommodates a fixed contact member 51. As shown in FIG. 5, a fixed contact **51*a* is formed at one end of the fixed contact member 51 and the fixed contacts 51*a* are disposed opposite to moving contacts 4*a* fitted to the respective ends of the moving contact member 4** after being assembled.

Moreover, a plug-in connection type male terminal **51*b* (hereinafter referred to as tab) is formed at the other end of the fixed contact member 51. A hole or indentation 51*e*** is used to prevent an inserted female terminal (connector) (not shown) from slipping off.

A sawtooth-like protrusion **51*c* is formed in the lower portion of the tab 51*b* and inserted into a slit 50*a* of the terminal cover 50. The tab 51*b* is tentatively fixed in the direction opposite to that of its insertion, and it is projected from the terminal cover 50**.

During the insertion and assembly, a protrusion **51*d* provided in the mid-portion of the fixed contact member 51 is also inserted in a groove 50*b* of the terminal cover 50 as shown in FIG. 6 and used for regulating the position of the fixed contact member 51. At this time, a pin 50*c* of the terminal cover 50 is also passed through a circular hole 51*f* of the fixed contact member 51 as shown in FIG. 1**.

The combinations of the terminal covers 50 and the fixed contact members 51 thus assembled are inserted into the housing 1 from directions of arrows E and G of FIG. 1, respectively. Each upper side face **50*d* of the terminal cover 50 as shown by oblique lines of FIG. 5 is guided to and inserted in the groove 1*a* of the housing 1 shown in FIG. 3, whereas the upper face 50*e* of each pole of the terminal cover 50 is guided to and inserted in the recess 1*b* of the housing 1**.

A stepped part 50*f* of the front end of the terminal cover 50 as shown in FIG. 5 is also fitted into a corresponding recess of the housing 1.

At the final stage of the insertion, half-cut holes 50*g* provided at the ends of the terminal cover 50 are respectively mated with mating protrusions 1*c* provided at both ends on the power supply and load sides of the housing 1, whereby the position of the terminal cover 1 is regulated in the vertical direction in FIG. 1.

Moreover, the pin 50*c* of the terminal cover 50 is forced up by an insertion guide face 1*d* of the housing 1 during the course of insertion as shown in FIG. 1 and returned to the original shape because of elasticity inherent in the material of the terminal cover 50 upon completion of insertion. The tip of the pin 50*c* thus fits into the stopper recess 1*e* of the housing 1 as shown in FIG. 1 and stopped from slipping off in the direction opposite to that of insertion. Further, each fixed screw 12 is passed through a hole 50*h* provided at the end of the terminal cover 50 and a hole 1*f* provided on the power supply or load side of the housing 1 to be tightened to the base 2, so that the terminal cover 50 is restricted in its vertical and horizontal movement in FIG. 1.

Tongues 51*g* provided in the vicinity of the fixed contact 51*a* of the fixed contact member 51 are kept inserted in the grooves 1*g* provided in barrier walls between the poles of the housing 1 during the course of the insertion of the terminal cover 50 so that the vertical position of the fixed contact 51*a* shown in FIG. 1 does not move to the extent exceeding the backlash of the thickness of each tongue 51*g* with respect to the groove 1*g*.

Subsequently in FIGS. 4 and 8, a coil terminal support 53*a* is provided at the end of the coil frame 53 on which the operating coil 10 is wound and a coil terminal 52 is fixedly fitted in a groove 53*b* of this portion by its spring force. The terminal 10*a* of the operating coil 10 is wound on one end 52*a* of the coil terminal 52 and connected thereto by soldering or the like, the other end thereof forming a plug-in connection type male terminal (tab) 52*b*.

The tab 52*b* is passed through a terminal slit 50J provided in the terminal cover 50 and regulated with respect to its vertical and horizontal positions in FIG. 2. As for the vertical position of the coil terminal 52 in FIG. 4, its downward direction is fixedly regulated as the underside of the coil terminal 52 abuts against the coil terminal support 53*a* of the coil frame 53, whereas it upward direction is fixedly regulated as the coil-terminal supporting projection 50K of the terminal cover 50 abuts against and presses the surface of the coil terminal 52.

A description of the operation of closing and opening the circuit as an electromagnetic contactor will be omitted as the operation is quite similar to the conventional one. The connection and removal of the plug-in connection type terminal will subsequently be described.

The mating of the side surface 50*d* of the terminal cover 50 with the housing 1, that of the surface 50*e* of each pole front portion of the terminal cover 50 with the recess 1*b* of the housing 1, and that of the half-cut hole 50*g* of the terminal cover 50 with the mating protrusion 1*c* of the housing 1 ensure that the terminal cover 50 is fixed to the housing 1 in the vertical direction in FIG. 1. Further, the mating of the pin 50C of the terminal cover 50 with the stop recess 1*e* of the housing and the fastening of the fixed screw 12 ensure that the terminal cover is fixed in the horizontal direction in FIG. 1. When the plug-in connection type female terminal (not shown) is connected to or removed from the fixed contact member 51, the underside of the fixed contact member 51 abuts against the guide face 1*d* of the housing 1 at the time of connection, i.e. against the force in direction of arrow A of FIG. 1, whereas the upper surface of the fixed contact member 51 abuts against the underside 50*l* of the terminal cover 50 as to the direction of arrow B. Since the terminal cover 50 is completely fixed to the housing 1 at this time, its deformation, backlash and so on can be prevented. As the terminal cover 50 is also fixed thereto likewise against the force in direction of arrow C, no backlash nor deformation is produced.

Although there is apprehension about the destructive strength of the peripheral plastic parts during operation, especially against the force in directions of arrows B and C, it is possible to increase the marginal destructive strength by forming the terminal cover of resilient plastic material such as thermoplastic resin or the like so as to absorb the force applied to the fixed contact member 51 in these directions through the minute deformation of the terminal cover 50.

Even when the minute deformation of the terminal cover 50 or minute backlashes of the terminal cover 50 and the fixed contact member 51 is produced, the vertical movement of the fixed contact 51 in FIG. 1 is minimized as the tongue 51*g* of the fixed contact member 51 is inserted in the groove 1*g* of the housing 1. Thus, the factor important for closing the contact indicated by the over travel amount is less fluctuated, whereby the risk of functional failure can be prevented.

Although a description has been given to the structure in which the pin is utilized to secure the terminal cover to the housing, a stepped portion provided in the housing and/or terminal cover for using their elasticity or an elastic member provided therebetween may be used.

A description will subsequently be given to attaching and detaching the plug-in connection type female terminal (not shown) to and from the coil terminal 52.

The plug-in connection type female terminal can be attached and detached in almost the same manner as in the case of the fixed contact member 51. The forces in directions of arrows H, J, K of FIG. 4 act on the coil terminal 52. Against the force in direction H, the underside of the coil terminal 52 and the coil terminal support 53*a* of the coil frame abut against each other. Against the force in direction of J, the upper surface of the coil terminal 52 and the coil terminal support protrusion 50K of the terminal cover 50 abut against each other. Against the force in direction of arrow K, further, the inner periphery of the coil terminal slit 50J of the terminal cover 50 and the tab 52*b* abut against each other. Accordingly, the movement of the coil terminal 52 is regulated, and deforming and backlashing of the coil terminal 52 can be prevented and thus the disconnection of the connecting portion of the terminal 10*a* of the operating coil 10 can be prevented.

The base instead of the coil frame may be employed for mating purposes.

Although the terminal cover 50 is inserted in the recess of the housing 1 in the above embodiment, the housing 1 may be provided with a boss to be fitted into a recess provided in the terminal cover 50 to fix the terminal cover vertically as shown in FIG. 1.

Also, in the above embodiment, the terminal cover 50 for three poles combined with the three fixed contact members 51 is inserted into the housing 1 for assembly. However, the number of poles may be one or increased up to more than three.

As set forth above, according to the present invention, the combination of the fixed contact member and the plug-in connection type male terminal is inserted into the slit of the terminal cover and further the resulting combination is fixedly inserted into the housing. Accordingly, deformation and backlash occurred at the attachment or detachment of the female terminal to or from the male terminal can be made extremely small and an inexpensive electromagnetic contactor can be made by the reduction of the number of parts, the assembling process using insertion and the like.

Moreover, the terminal cover is mated with the housing upon completion of the insertion of the terminal cover to ensure that the terminal cover is fixed in the slip-off direction (opposite to insertion).

Further, the connection conductor is mated with the housing and the terminal cover so that the vertical movement of the fixed contact member is suppressed. Thus, the factor important for closing the contact becomes free from variation and therefore a highly reliable electromagnetic contactor is obtainable.

The plug-in connection type male terminal provided at an end of the coil terminal is fixedly inserted into the coil terminal slit provided at an end of the terminal cover. As a result, deformation, backlash and the like due to the force resulting from attaching or detaching the female terminal can be prevented. Further, inconvenience of loss of the primary function such as breakage of the coil terminal connection can be prevented.

What is claimed is:

1. An electromagnetic contactor, comprising:

a plug-in connection type male terminal as a wiring terminal;

a fixed contact member;

a resin-molded housing for accommodating said fixed contact member in its inner space;

a resin-molded terminal cover having a slit opened to the outside, said terminal cover being inserted into said housing from the outside for assembly along a guide portion of a recess or boss formed in said housing; and a fixed-contact-member connection conductor formed of a bent metal plate having a contact of said fixed contact member at one end and said plug-in connection type male terminal at the other end, said plug-in connection type male terminal projecting from said slit, said fixed-contact-member connection conductor being further provided with a mating portion which mates with said terminal cover so that said connection conductor in combination with said terminal cover can be placed in said housing.

2. An electromagnetic contactor as claimed in claim 1, wherein said slit, into which said plug-in connection type male terminal has been inserted, and respective mating portions of said terminal cover and said housing are used to bear a load applied to said male terminal, said respective mating portions being in contact with a bent face of said fixed-contact-member connection conductor.

3. An electromagnetic contactor as claimed in claim 1 or 2, wherein said mating portion of said fixed-contact-member connection conductor mates with said terminal cover and said housing, whereby the positioning of said connection conductor is carried out.

4. An electromagnetic contactor as claimed in claim 1 or 2, wherein when said terminal cover is inserted in said housing for assembly, an elastic member provided between said terminal cover and said housing is used to carry out positioning and mating of said terminal cover at a position where the insertion is completed.

5. An electromagnetic contactor, comprising:

a coil;

a plug-in connection type male terminal as a wiring terminal to be connected to said coil;

a resin-molded base for accommodating said coil in its inner space;

a resin-molded housing fitted in said base to be integrally assembled, said housing accommodating a contact member in its inner space;

a resin-molded terminal cover having a slit passed through an outer end thereof, said terminal cover being capable of insertion into said housing from the outside for assembly along a guide portion of a recess or boss formed in said housing; and a coil connection conductor formed of a bent metal plate having a wiring connection to said coil at one end and said plug-in connection type male terminal at the other end, said plug-in connection type male terminal being passed through and projected from said slit, said connection conductor being supported by and mated with said base.

6. An electromagnetic contactor as claimed in claim 5, wherein said slit into which said plug-in connection type external terminal has been inserted and said base mating with said coil connection conductor are used to bear a load applied to said external terminal.

7. An electromagnetic contactor as claimed in claim 5, wherein said coil connection conductor is supported by and mated with said base via a coil frame combined with said coil.

8. An electromagnetic contactor as claimed in claim 5, wherein said base and said housing are fastened by a bolt.

9. An electromagnetic contactor as claimed in claim 7, wherein said coil connection conductor is fixedly fitted in a groove provided in said coil frame.

10. An electromagnetic contactor equipped with plug-in connection type male terminals as wiring terminals, comprising a plurality of fixed contact members each of which is formed of a metal plate having a contact at one end and a plug-in connection type male terminal at the other, and each of which is inserted into a resin-molded terminal cover so that said male terminal of said fixed contact member protrudes from a slit provided in said terminal cover; wherein assemblies of said terminal cover and said fixed contact member are respectively inserted into power supply and load sides of a housing along guide portions of recesses and grooves formed in said housing.

11. An electromagnetic contactor as claimed in claim 10, wherein, when said assemblies are inserted for assembly along the guide portions of the recesses and the grooves formed in said housing, a pin provided on an underside of said terminal cover is mated with a stopping recess provided in said housing in a position where insertion is completed.

12. An electromagnetic contactor as claimed in claim 10 or 11, wherein a tongue provided in the vicinity of said contact of said fixed contact member is inserted in a groove provided in a wall between poles of said housing.

13. An electromagnetic contactor equipped with plug-in connection type male terminals as wiring terminals, wherein combinations assembled by respectively inserting fixed contact members into terminal covers are respectively inserted into power supply and load sides of a housing, each combination being inserted for assembly along a guide portion of a recess and a groove formed in said housing and wherein a plug-in connection type male terminal provided at one end of a coil terminal is passed through a slit provided in said terminal cover.

14. An electromagnetic contactor as claimed in claim 1, wherein said slit, into which said plug-in connection type male terminal has been inserted, and respective mating portions of said terminal cover or said housing are used to bear a load applied to said male terminal, said respective mating portions being in contact with a bent face of said fixed-contact-member connection conductor.

15. An electromagnetic contactor as claimed in claim 1 or 2, wherein said mating portion of said fixed-contact-member connection conductor mates with said terminal cover or said housing, whereby the positioning of said connection conductor is carried out.

* * * * *